US007754965B2

(12) United States Patent
Rizk et al.

(10) Patent No.: US 7,754,965 B2
(45) Date of Patent: Jul. 13, 2010

(54) FLASHOVER PROTECTION DEVICE AND METHOD: WET/DRY GLOW-BASED STREAMER INHIBITOR

(76) Inventors: Farouk A. M. Rizk, 98 De La Moselle, St-Lambert, Quebec (CA) J4S 1W2; Amr Rizk, 98 De La Moselle, St-Lambert, Quebec (CA) J4S 1W2

( * ) Notice: Subject to any disclaimer, the term of this patent is extended or adjusted under 35 U.S.C. 154(b) by 508 days.

(21) Appl. No.: 11/753,961

(22) Filed: May 25, 2007

(65) Prior Publication Data

US 2008/0020655 A1 Jan. 24, 2008

Related U.S. Application Data

(60) Provisional application No. 60/808,573, filed on May 26, 2006.

(51) Int. Cl.
*H01B 17/34* (2006.01)

(52) U.S. Cl. ..... 174/30; 174/31 R; 174/138 G; 174/15.5; 174/15.6; 336/59

(58) Field of Classification Search ..... 174/144, 174/3, 15.5, 15.6, 138 G, 30, 31 R, 138 H; 336/59, 60

See application file for complete search history.

(56) References Cited

U.S. PATENT DOCUMENTS 1,813,151 A * 7/1931 Eaton ..... 174/144
3,471,632 A * 10/1969 Cox et al. ..... 174/141 R
3,609,218 A 9/1971 Raymond et al.
3,825,671 A 7/1974 Pokorny
3,930,113 A 12/1975 Johansen et al.
4,180,698 A 12/1979 Carpenter, Jr.
4,458,101 A * 7/1984 Cookson et al. ..... 174/31 R
4,458,107 A 7/1984 Héroux
4,605,814 A 8/1986 Gillem
4,679,114 A 7/1987 Carpenter, Jr.
4,910,636 A 3/1990 Sadler
5,043,527 A 8/1991 Carpenter, Jr.
5,073,678 A 12/1991 Carpenter, Jr.

(Continued)

FOREIGN PATENT DOCUMENTS

CA 1205514 6/1986

(Continued)

OTHER PUBLICATIONS

U.S. Appl. No. 10/866,609, filed Dec. 16, 2004, Hesse.

(Continued)

*Primary Examiner*—Dhiru R Patel
(74) *Attorney, Agent, or Firm*—Goudreau Gage Dubuc Gonzalo Lavin

(57) ABSTRACT

A device and method for reducing the risk of a streamer initiated flashover across a high voltage insulator under normal operating voltages. The device includes a support structure adapted to be grounded and mounted in proximity to the high voltage insulator; and space charge producing conductors wound around the support structure and forming coils for producing space charge in a proximity of an insulator to be protected, and inhibiting a formation of positive streamers, each conductor having a diameter not exceeding 0.1 mm for reducing a corona inception voltage of the support structure upon which each conductor is wound, in both dry and wet conditions.

40 Claims, 8 Drawing Sheets

U.S. PATENT DOCUMENTS

| | | | |
|---|---|---|---|
| 5,932,838 | A | 8/1999 | Carpenter, Jr. |
| 6,017,628 | A | 1/2000 | Stevens et al. |
| 6,069,314 | A | 5/2000 | Varela |
| 6,307,149 | B1 | 10/2001 | Zini et al. |
| 6,320,119 | B1 | 11/2001 | Gumley |
| 7,236,341 | B1 | 6/2007 | Carpenter |
| 2003/0067731 | A1 | 4/2003 | Kent |
| 2003/0103311 | A1 | 6/2003 | Zhuang |
| 2004/0130842 | A1 | 7/2004 | Johansen |
| 2005/0146832 | A1 | 7/2005 | D'Alessandro |
| 2007/0115607 | A1 | 5/2007 | Rizk et al. |
| 2007/0217113 | A1 | 9/2007 | Rizk et al. |

FOREIGN PATENT DOCUMENTS

| | | |
|---|---|---|
| CA | 2543551 | 6/2005 |
| EP | 0488695 | 6/1992 |
| SU | 1552899 A1 * | 9/1995 |

OTHER PUBLICATIONS

Farouk A.M. Rizk, Modeling of Lightning Incidence to Tall Structure Part I: IEEE Trans. on Power Delivery, Canada, Jan. 1994, vol. 9, No. 1, pp. 162-171.

Farouk A.M. Rizk, Modeling of Lightning Incicdence to Tall Structure Part II: IEEE Trans. on Power Delivery, Canada, Jan. 1994, vol. 9, No. 1, pp. 172-193.

Farouk A.M. Rizk, A model for Switching Impulse Leader Inception and Breakdown of Long Air-Gaps: IEEE Trans. on Power Delivery, Canada, Jan. 1989, vol. 4, No. 1, pp. 596-606.

Farouk A.M. Rizk, Switching Impulse Strength of Air Insulation: Leader Inception Criterion: IEEE Trans. on Power Delivery, Canada, Oct. 1989, vol. 4, No. 4, pp. 2187-2195.

Farouk A.M. Rizk, Influence of Rain on Switching Impulse Sparkover Voltage of Large Electrode Air-Gaps: IEEE Trans. on Power Apparatus and Systems, Canada,Jul./Aug. 1976, vol. PAS-95, No. 4, pp. 1394-1402.

Farouk A.M. Rizk, Modeling of Transmission Line Exposure to Direct Lightning Strokes: IEEE Trans. on Power Delivery, Canada, Oct. 1990, vol. 5, pp. 1983-1997.

C.A.E. Uhlig, "The Ultra Corona discharge, A New Discharge Phenomenon Occuring on Thin Wires", Proceedings of High Voltage Symposium, National Research Council of Canada, Ottawa, 1956, paper No. 15.

C.A.E. Uhlig, "A.C. Corona Current and Loss on Thin Wires from Onset to Sparkover", Proceedings of High Voltage Symposium, National Research Council of Canada, Ottawa, 1956, paper No. 16.

V.I. Popkov, "Some Special Features of Corona on High-Voltage DC Transmission Lines", in GAS Discharges and the Electric Supply Industry, Proceedings of International Conference, CERL, Leatherhead, surry, England, May 1962, pp. 225-237.

N.G. Trinh, J.B. Jordan, "Modes of Corona Discharge in Air", IEEE Trans, May 1968, vol. PAS-87, No. 5, pp. 1207-1215.

P. Heroux. P.S. Maruvada, M.G. Trinh, "High voltage AC Transmission Lines: Reduction of Corona Under Foul Weather" IEEE Trans., Canada, Sep. 1982, vol. PAS-101, No. 9, pp. 3009-3017.

* cited by examiner

FLASHOVER PROTECTION DEVICE AND METHOD: WET/DRY GLOW-BASED STREAMER INHIBITOR

CROSS-REFERENCE TO RELATED APPLICATION

This application claims priority on U.S. Provisional Application No. 60/808,573 entitled Flashover Protection Device and Method: Wet/Dry Glow-Based Streamer Inhibitor and filed May 26, 2006, the entirety of which is herein incorporated by reference.

FIELD OF THE INVENTION

The present invention relates to protection against flashovers on or across high voltage insulators in power systems under normal operating voltage.

BACKGROUND OF THE INVENTION

According to the International Electrotechnical Commission (IEC), external insulation is defined as "distances in atmospheric air, and the surfaces in contact with atmospheric air of solid insulation of the equipment which are subject to dielectric stresses and to the effects of atmospheric and other external conditions such as pollution, humidity, vermin, etc" [IEV 604-03-02]. This is the type of insulation dealt with in this patent application.

According to IEC Standard 71-1 (1996) dielectric stresses have several origins, the most basic of which is continuous voltages which originate from the system operation under normal operating conditions. This is the type of voltage or dielectric stress origin dealt with in this patent application.

Failure (flashover) of external insulation under normal operating voltage normally takes place when insulating surfaces are exposed to critical pollution conditions. Flashovers of insulators under normal operating voltage are characterized by several stages: flow of leakage current due to surface conductivity, formation of dry bands, bridging the dry bands by electric arcs and finally propagation of the arcs to span the whole length of the surface insulation. Sparkovers of air insulation on the other hand do not normally occur under system operating voltage since such voltages are normally too low to cause sparkover of air gaps.

Such gaps however do sparkover under the effects of lightning overvoltages caused by direct or induced lightning. The mechanism of the sparkover in this case involves positive and negative streamers emanating from the high voltage and ground terminals (electrodes). Of particular importance is the positive streamer which, due to its lower voltage gradient, is capable of spanning longer insulating distances. This type of sparkover is not preceded by the flow of any significant leakage current.

Similar sparkovers of air insulation can occur due to system overvoltages occurring due to faults and switching operations. Here air gap sparkover can occur, without flow of leakage current, by the streamer mechanism, described above. More importantly and particularly at extra-high-voltage systems, positive streamers can result in the formation of a positive leader discharge, with considerably lower voltage gradient and accordingly having the ability to span much longer insulating distances.

In this patent application we will deal with a special type of flashover/sparkover streamer/leader mechanism recently discovered and for which the name "Fast Flashover" has been coined. These Fast Flashovers have some particular characteristics:

1. Fast Flashovers occur under normal system operating voltages without any effect of lightning or switching operations.
2. Fast Flashovers occur without any significant flow of leakage current (contrary to the case of pollution flashovers).
3. The last characteristic makes Fast Flashovers particularly dangerous because of the difficulty in predicting them, particularly in cases involving personnel safety
4. Positive streamers represent a prerequisite for the occurrence of a Fast Flashover, so that inhibiting positive streamers constitutes the most logical means of eliminating Fast Flashovers.

Combating fast flashover by either increasing the length of the insulator (gap) or by introducing insulating sheds may not always be practical or economic.

An object of the present invention is therefore to reduce the risk of such fast flashovers by inhibiting the development of streamers under different atmospheric conditions with the insulators only exposed to the system operating voltage.

At present there is no known device for reducing the risk of a streamer initiated flashover on a high voltage insulator under normal operating voltage.

US Patent publication No. 2004251700 (HESSE) discloses safety devices and methods for allegedly improving electrical safety of insulative tools. In particular, it is applied to an elongated insulative tool of a certain length with a substantially circular cross section having a cross sectional diameter and outer circumference. The device comprises a body which may be a substantially circular disc with an inner opening for the elongated insulative tool to position there through, and the inner opening has a bore diameter that is substantially the same as or greater than the diameter of the elongated insulative tool. However, test conducted on an embodiment of such device, a bare toroird, revealed that it is not effective in reducing the risk of fast flashovers or pollution flashovers.

A Wet/Dry Glow-Based Streamer Inhibitor, disclosed in U.S. provisional patent application filing No. 60/738,990, which is incorporated by reference, although not designed to affect flashovers on transmission lines, possesses many physical similarities to the invention disclosed here within but it has an entirely different application. While the purpose of a Wet/Dry Glow-Based Streamer Inhibitor (U.S. provisional patent application filing No. 60/738,990) is to reduce exposure of structures, transmission lines and substations to direct lightning strokes, the present application deals with reducing the risk of a flashover on high voltage power transmission systems under normal operating voltage. Inhibition of positive streamers is fundamental to both applications.

There is therefore a need for a device that can prevent flashovers on or across high voltage insulators conventionally used in power systems, such as streamer initiated flashovers, including streamer-initiated or fast flashovers.

STATEMENT OF THE OBJECT OF THE INVENTION

A first possibility for controlling positive streamer/leader inception is to modify the electrode geometry. It must be noted however that if the equivalent radius of the structure terminal, defined as the applied potential divided by the electric field at the terminal surface, is below a critical value, the so-called critical radius, the geometry of the structure has practically no effect on positive leader inception. If on the other hand the electrode geometry is modified by introducing a conducting surface with a large radius of curvature, the leader inception voltage can indeed be increased but only under dry conditions. Under rain however the leader inception level from the large electrode will be the same as with an electrode whose equivalent radius is equal to or smaller than the critical radius.

A second technique for controlling discharge activity from an electrode is by space charge shielding. For the device producing positive space charge to be successful in protecting a terminal or preventing a fast flashover, several prerequisites are in order:

1. The space charge producing device must not produce corona in the positive streamer mode. Such positive streamer production will defeat the purpose of positive space charge generation and may in fact enhance the probability of a flashover.
2. The device must be able to be streamer free not only under dry conditions but also under wet conditions.
3. The device must be able to produce sufficiently high rates of space charge, streamer free, to achieve its intended goal even under windy conditions.
4. The device must afford some means of control of the production of space charge so as to be applicable in a variety of situations and conditions There is therefore a need for a device that meets the required criteria listed for the space charge shielding technique for controlling discharge activity from a high voltage or grounded electrode.

SUMMARY OF THE INVENTION

According to a first aspect of the present invention, there is provided a device for reducing the risk of a flashover on or across a high voltage insulator under normal operating voltages, the device comprising:

a support structure adapted to be grounded and mounted in proximity to the high voltage insulator; and space charge producing conductors wound around the support structure and forming coils for producing space charge and inhibiting a formation of positive streamers, each conductor having a diameter not exceeding 0.1 mm for reducing a corona inception voltage of the support structure upon which each conductor is wound, in both dry and wet conditions.

According to another aspect of the present invention, there is provided a device for reducing the risk of a flashover on or across a high voltage insulator under normal operating voltages, the device comprising:

a support structure adapted to be grounded and mounted in proximity to the high voltage insulator; and conductors disposed on the support structure.

Preferably, a device for reducing the risk of a flashover on or across an insulator comprises the following characteristics:

It comprises coil(s) consisting of very thin (diameter less than 0.1 mm) conducting wires or fibers, or fabrics made of such fibers or wires for the production of space charge;

It functions in both wet and dry conditions;

It only produces corona in the pulseless-glow mode (streamer free) even in exceptionally high fields; and It provides means of control of the rate of space charge production.

According to another aspect of the present invention, there is provided a device comprising a support structure, preferably of, but not limited to, a structure defining an inner opening for preferably receiving the insulator there through, the structure spanning generally radially outwardly from the inner opening to lie substantially transversely to a longitudinal direction of the insulator received there through, and disposed upon which structure is very thin conducting wire, fiber, or filaments. The conducting wires or fibers are so thin that when they get into corona they produce a glow-type discharge without forming streamers in dry as well as wet conditions. An accumulated space charge of appropriate polarity in the proximity of a high voltage insulator string will induce charges on the supporting structure of the inhibitor and on any other conducting bodies in it's vicinity of such a magnitude and polarity as to inhibit the development of streamers and reduce the risk of a flashover between the high voltage line and the ground-end of the insulator.

Preferably, the insulators for which the device of the present invention is applicable are primarily elongated insulators. In general, a number of insulators have been devised and are commercially available for use in connection with equipment and/or componentry that are energized at high electrical voltages. Their individual designs, for example in respect of their composition, structural designs and dimensions, are tailored to accommodate the safe isolation of equipment and componentry energized to different levels. The basic principles governing such design requisites for the different types of insulators are generally known in the art, and overall guidelines and specifications are available for insulator manufacturers and users to ensure, in part, the minimal separation away from the energized equipment or componentry.

For example, one type of insulator applicable to the present invention is an insulator string attaching (whilst separating) a high voltage conductor to (and from) a transmission tower cross member. Another type of insulator is an elongated insulative pole, commonly fiberglass reinforced, with different adaptors and tools affixed onto a terminus thereof commonly used to perform different tasks and functions on high-voltage electricity equipment or componentry. Notwithstanding, it should be readily apparent to a person skilled in the art that the device of the present invention would also improve the safety of other elongated insulator objects used in high voltage applications, such as booms and alike extension apparatus, against streamer-initiated or fast flashovers.

In one preferred embodiment, the device comprises a support structure having a substantially circular disc configuration, which may be a substantially cylindrical, bi-convex, semi-convex, biconcave, semi-concave, spheroidal or semi-spheroidal disc, with an inner opening having a bore diameter that is larger than the thickness of the insulator. Preferably, the support structure is substantially a toroid. The support structure of the present device can be made of a conducting material. Preferably, the support structure is made of a material that has good electricity conductive properties as well as sufficiently robust physicochemical properties to maximize integrity and longevity of the support structure.

Disposed upon the support structure is very thin wire, fiber, or filament, or bundles of filaments, yarn, or woven or knitted fabric, made from such thin wires, fibers or filaments, whether in single or multiple layers, in the longitudinal and/or the transverse sense. Preferably, the conducting wire, fiber, or filament, or bundles of filaments, yarn, or woven or knitted fabric, made therefrom, is wrapped transversely around the support to form continuous or sectionalized electric coil(s). The conducting wire, fiber, or filament, has a cross-sectional diameter or thickness of less than 0.1 mm, and is made of a conducting material, and preferably, the material has good electricity conductive properties and sufficiently robust physicochemical properties to maximize integrity and longevity of the wire, fiber, or filament, made thereof.

The device is provided with a ground connection to allow the inhibitor current to flow to ground.

In the case where the insulator is a high voltage insulator string on a power transmission tower, the conducting support structure for the inhibitor coil is provided with arcing terminals to receive and maintain any power-follow arc as a result of overvoltages due to lightning strikes, thereby reducing the exposure of the inhibitor coil to the effects of power arcs.

The use of a metallic toroid electrode as the support structure of the electric coil provides means for controlling the electric field to which the coil is actually exposed due to the energized line voltage. This is principally done by adjustment of the toroid's minor diameter. By reducing the minor diameter of the support structure one reduces the corona inception of the device. By increasing the major diameter of the device one increases the total surface area and thus the rate of space charge produced. It is important to adjust the rate of space charge to the particular application as too much space charge or too little space charge could hinder the maximization of the desired affect.

In addition to field control by the dimensions, the winding pitch of the coil determines the length of the space charge producing conductor and therefore the rate of positive charge production around the device. This provides unique possibilities for charge control and determination of the sensitivity of the device (Inhibitor) to the field due to the energized line.

The described invention provides additional simple means of increasing charge production, under otherwise the same conditions through the use of multiple properly spaced Inhibitor coils.

The positive space charge generated by the Inhibitor coil is produced as soon as the corona inception criterion is fulfilled at the space charge producing element of the Inhibitor coil. Thus any charge removed by wind immediately enhances the resultant electric field perpendicular to the electrode's surface and increases the rate of charge production until a situation of equilibrium is reached between charge removal and charge production.

Because of this unique property of producing high rates of space charge without streamers, in both dry and wet conditions, the coil will have the effect of inhibiting streamer formation from the protected object and thus reduce its vulnerability to a flashover.

According to another aspect of the present invention, there is provided a method of making a device for reducing the risk of a flashover across or on a high voltage insulator under normal operating voltages, the method comprising steps of:

a) providing a support structure adapted to be grounded and mounted in proximity to the high voltage insulator; and b) winding space charge producing conductors around the support structure and forming coils for producing space charge and inhibiting a formation of positive streamers, each conductor having a diameter not exceeding 0.1 mm for reducing a corona inception voltage of the support structure upon which each conductor is wound, in both dry and wet conditions.

According to yet another aspect of the present invention, there is provided a method of protection against flashovers on or across insulators, the method comprising:

providing at least one device of the present invention comprising a support structure defining preferably but not limited to an inner opening for receiving the insulator there through, the support structure spanning generally radially outwardly from the inner opening; and disposed upon the support structure is very thin conducting wire, fiber, or filaments; and extending the insulator through the inner opening of said at least one device such that the support structure thereof lies substantially transversely to a longitudinal direction of the insulator received there through.

In one embodiment, and as aforementioned, the support structure has a substantially circular disc configuration, which may be a substantially cylindrical, bi-convex, semi-convex, biconcave, semi-concave, spheroidal or semi-spheroidal disc, with an inner opening having a bore diameter that is larger than the thickness of the insulator. Preferably, the support structure is substantially a toroid, and can be made of a conducting material, preferably a material that has good electricity conductive properties as well as sufficiently robust physicochemical properties to maximize integrity and longevity of the support structure. The conducting wire, fiber, or filament, or bundles of filaments, yarn, or woven or knitted fabric, made from such thin wires, fibers or filaments, whether in single or multiple layers, is disposed on the support structure in the longitudinal and/or the transverse sense, and preferably, same is wrapped transversely around the support to form a continuous or sectionalized electric coil. The conducting wire, fiber, or filament, has a cross-sectional diameter or thickness of less than 0.1 mm, and is made of a conducting material, preferably a material with good electricity conductive properties and sufficiently robust physicochemical properties to maximize integrity and longevity thereof.

The invention as well as its numerous advantages will be better understood by reading of the following non-restrictive description of preferred embodiments made in reference to the appended drawings.

DESCRIPTION OF PREFERRED EMBODIMENTS

Figure 1:
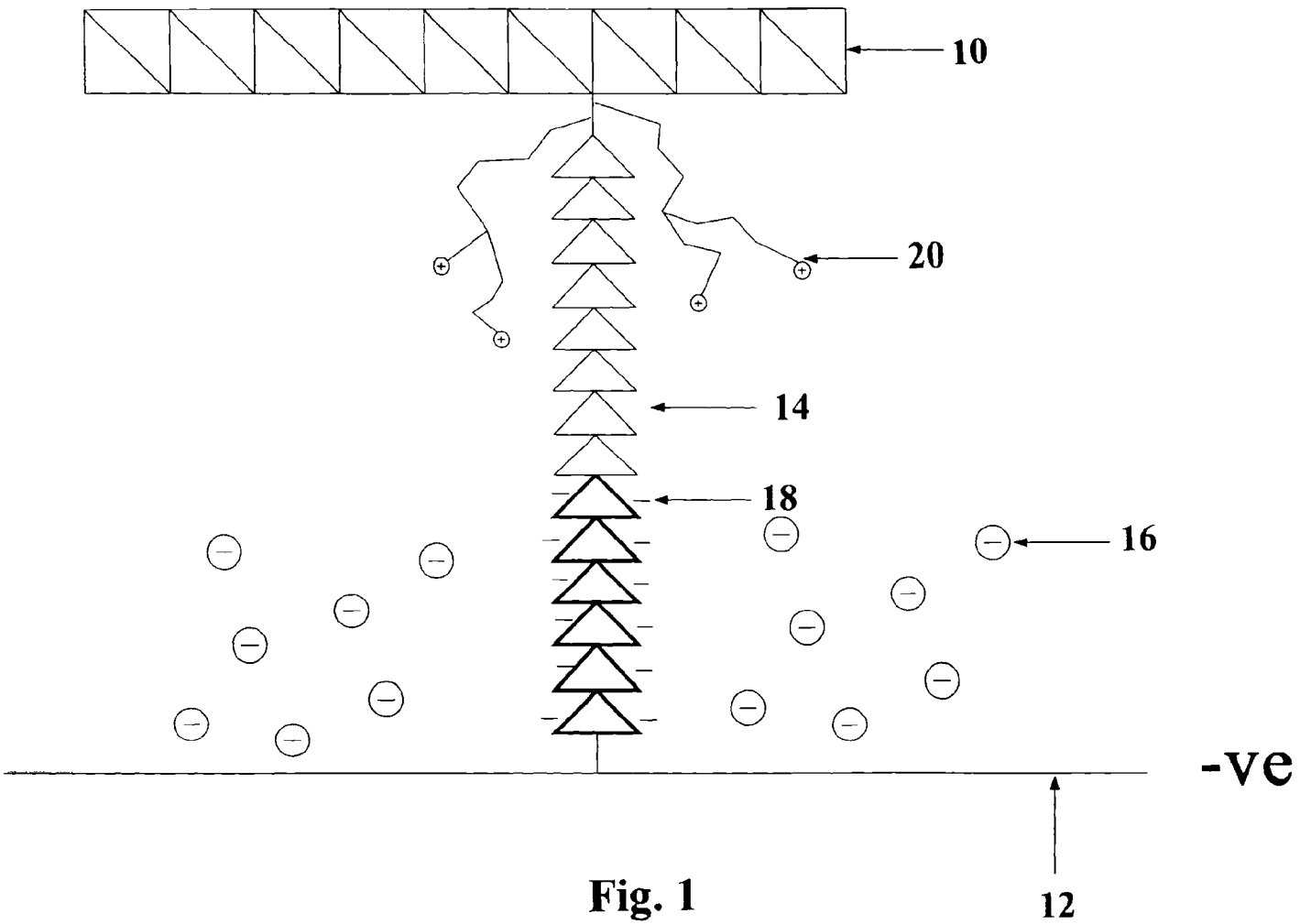
FIG. 1 is a partial view of a transmission tower with a high voltage insulator schematically representing a fast flashover mechanism on the negative dc pole or during the negative half-cycle of the AC voltage.

Referring to FIG. 1, there is shown a transmission tower 10 supporting a high voltage conductor 12 via an insulator string 14. This example provides a schematic representation of a fast flashover mechanism on the negative dc pole or during the negative half-cycle of the AC voltage. Negative space charge is generated from the high voltage conductor 12 and hardware that create a negative space charge cloud 16 which can partially settle as negative surface charge 18 on the insulator string 14. As the ground side of the insulator string 14 becomes more stressed, positive streamers 20 are created. If the positive streamer charge gets neutralized, a positive leader can form leading to complete failure.

Figure 2A:
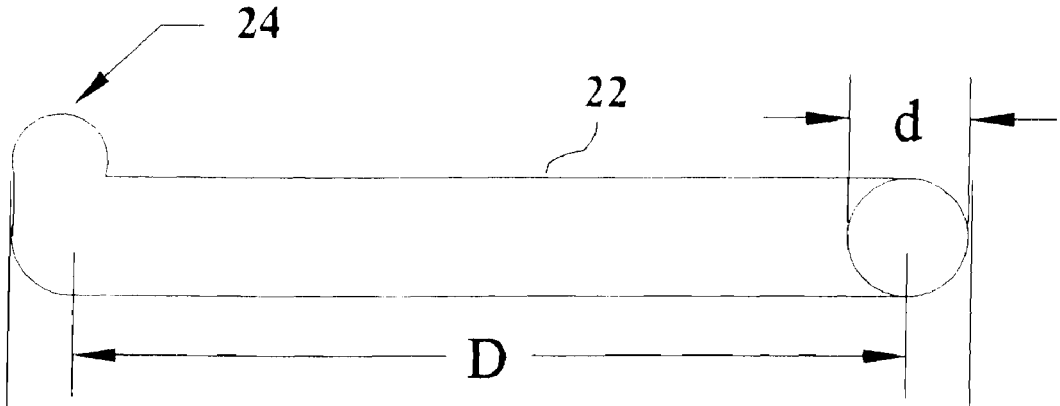
FIGS. 2*a* and 2*b* are respectively a side section and top views of an open toroidal streamer inhibitor 22 with arcing terminals 24 used as a support structure, according to a preferred embodiment of the present invention.
Figure 2B:
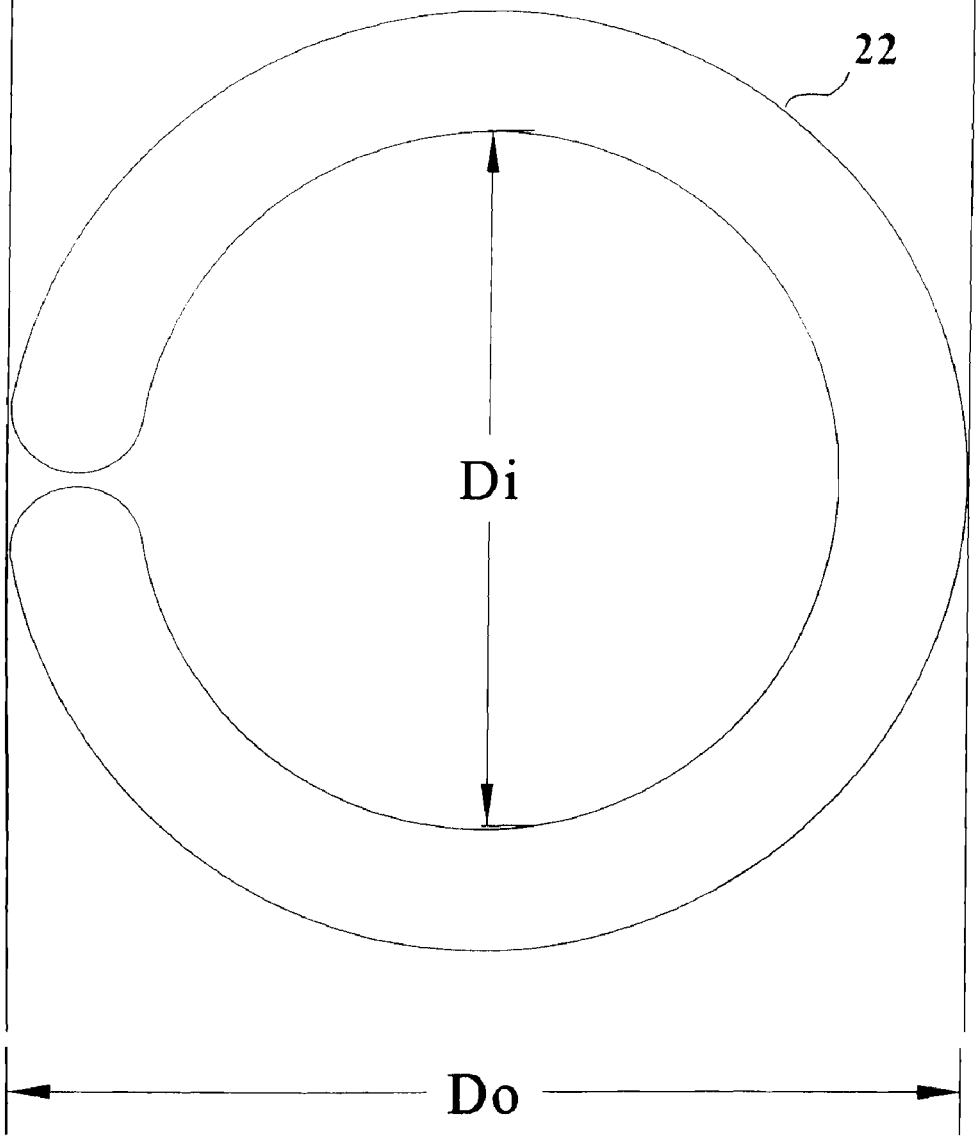

Referring to FIGS. 2*a* and 2*b*, there is shown an open toroidal streamer inhibitor 22 with arcing terminals 24 used as a support structure, according to a preferred embodiment of the present invention. The toroidal streamer inhibitor 22 is shown with its minor diameter d, major diameter D, inner major diameter Di, and outer major diameter Do. These establish the various parameters and dimensions which can be varied for the purposes of the invention.

Figure 3:
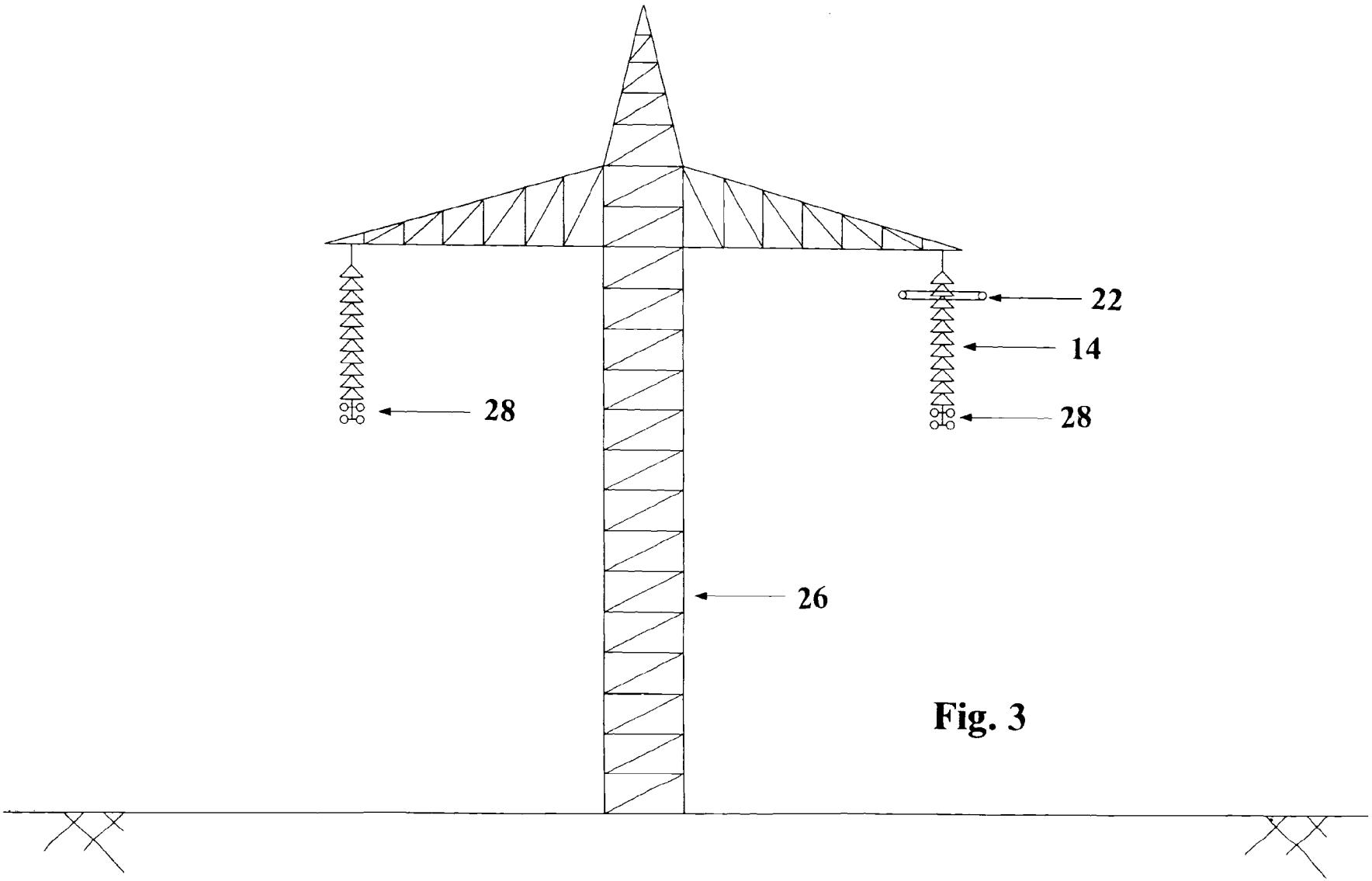
FIG. 3 is a side view of a high voltage DC transmission tower with a toroidal inhibitor mounted at the tower/ground-end of the insulator string that is supporting the negative polarity power conductor, according to a preferred embodiment of the present invention.

Referring to FIG. 3, there is shown a high voltage DC transmission tower 26 with an insulator string 14 supporting a negative polarity conductor bundle 28. As shown, a toroidal inhibitor 22 is mounted at the tower/ground-end of the insulator string, according to a preferred embodiment of the present invention. The toroidal inhibitor 22 is provided with space charge producing conductors (not illustrated) wound around it and forming coils for producing space charge and inhibiting a formation of positive streamers. Each conductor has a diameter not exceeding 0.1 mm for reducing a corona inception voltage of the support structure upon which each conductor is wound, in both dry and wet conditions.

Figure 4:
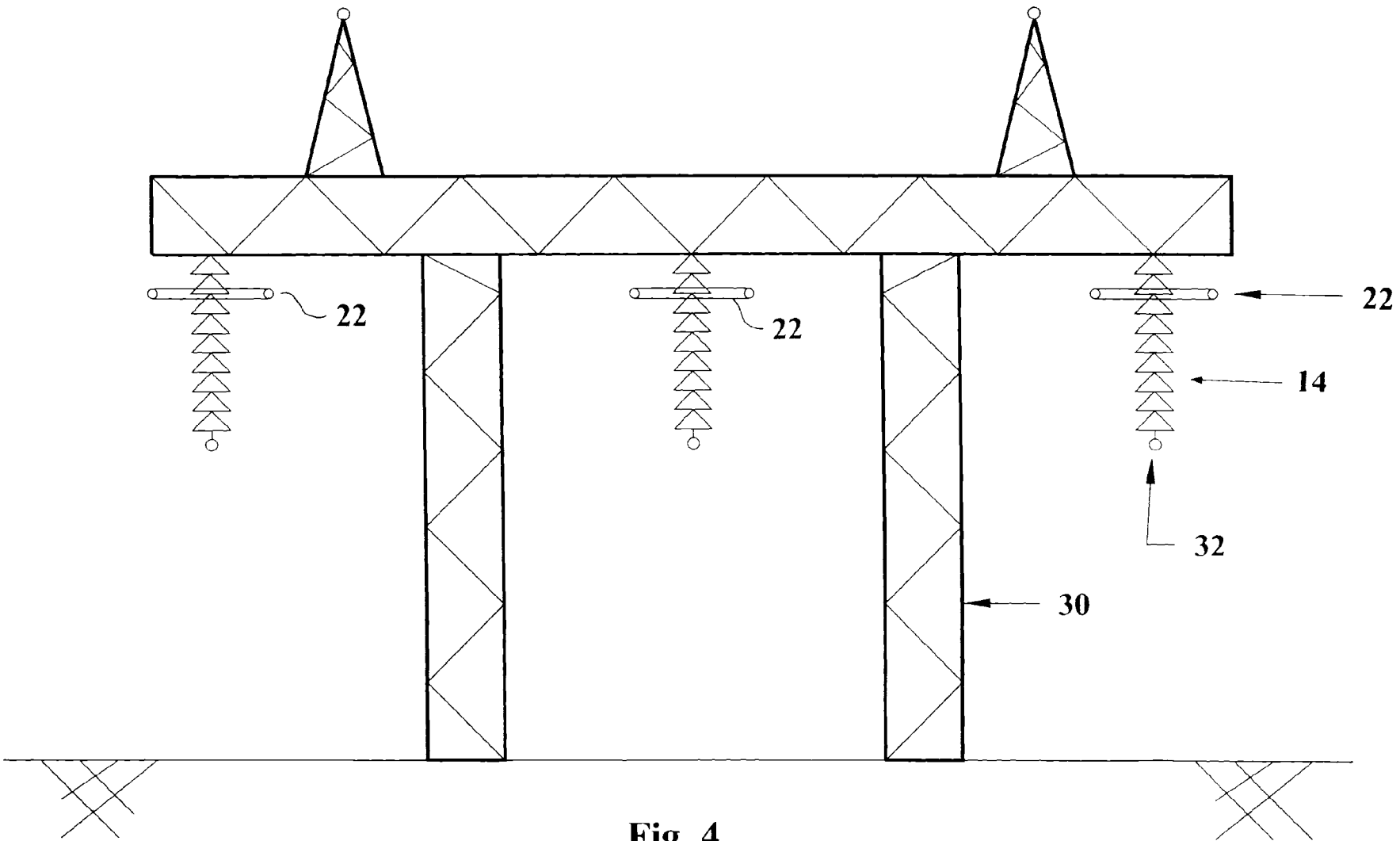
FIG. 4 is a side view of a high voltage AC transmission tower with toroidal inhibitors mounted at the tower/ground-end of the insulator strings according to a preferred embodiment of the present invention.

Referring to FIG. 4, there is shown a high voltage AC transmission line tower with an insulator string 14 supporting an AC power conductor 32. Similarly as above, a toroidal inhibitor 22 is mounted at the tower/ground-end of the insulator string 14, according to a preferred embodiment of the present invention. The toroidal inhibitor 22 is also provided with space charge producing conductors (not illustrated) wound around it, as described above.

Figure 5B:
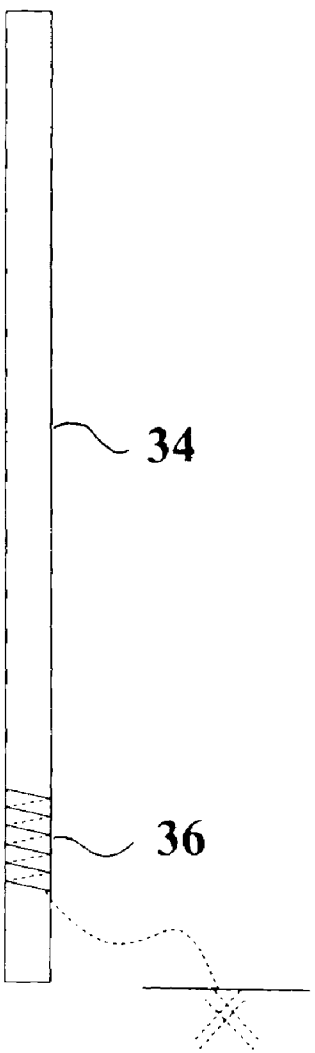
FIG. 5*b* is a side section view of an FRP stick with an inhibitor coil wound directly onto the ground-end of the stick, according to a preferred embodiment of the present invention.
Figure 5A:
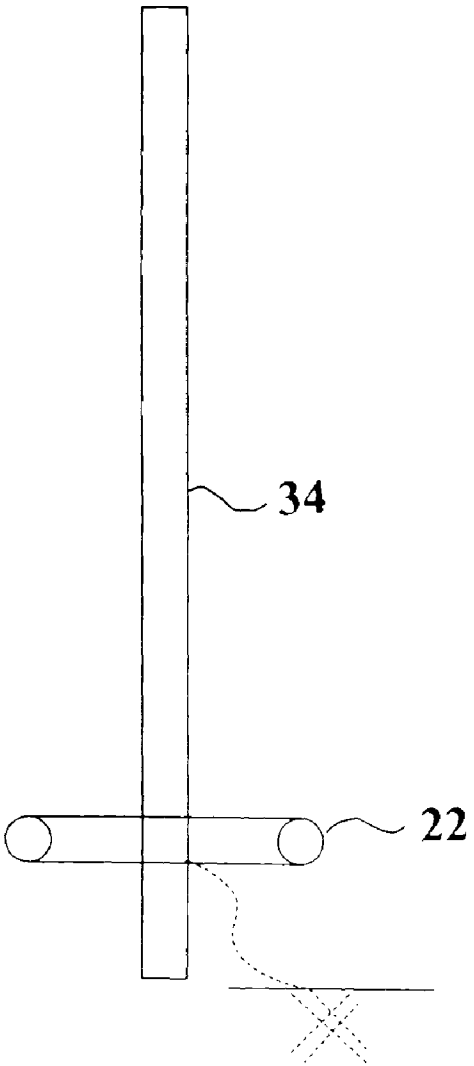
FIG. 5*a* is a side section view of a fiber-reinforced polymer (FRP) hot stick with a toroidal inhibitor mounted at the ground-end of the stick, according to a preferred embodiment of the present invention.

Referring to FIG. 5*a*, there is shown a fiber-reinforced polymer (FRP) hot stick 34 with a toroidal inhibitor 22 being mounted at the ground-end of the stick, according to a preferred embodiment of the present invention. The toroidal inhibitor 22 is provided with thin conductor coils (not illustrated) having a diameter not exceeding 0.1 mm and is adapted to be grounded.

Referring to FIG. 5*b*, there is shown an FRP hot stick 34 similar as above, but provided only with an inhibitor conductor coil 36 mounted directly onto the ground-end of the stick 34, according to a preferred embodiment of the present invention. The conductor coil 36 has a diameter not exceeding 0.1 mm and is adapted to be grounded.

Figure 6:
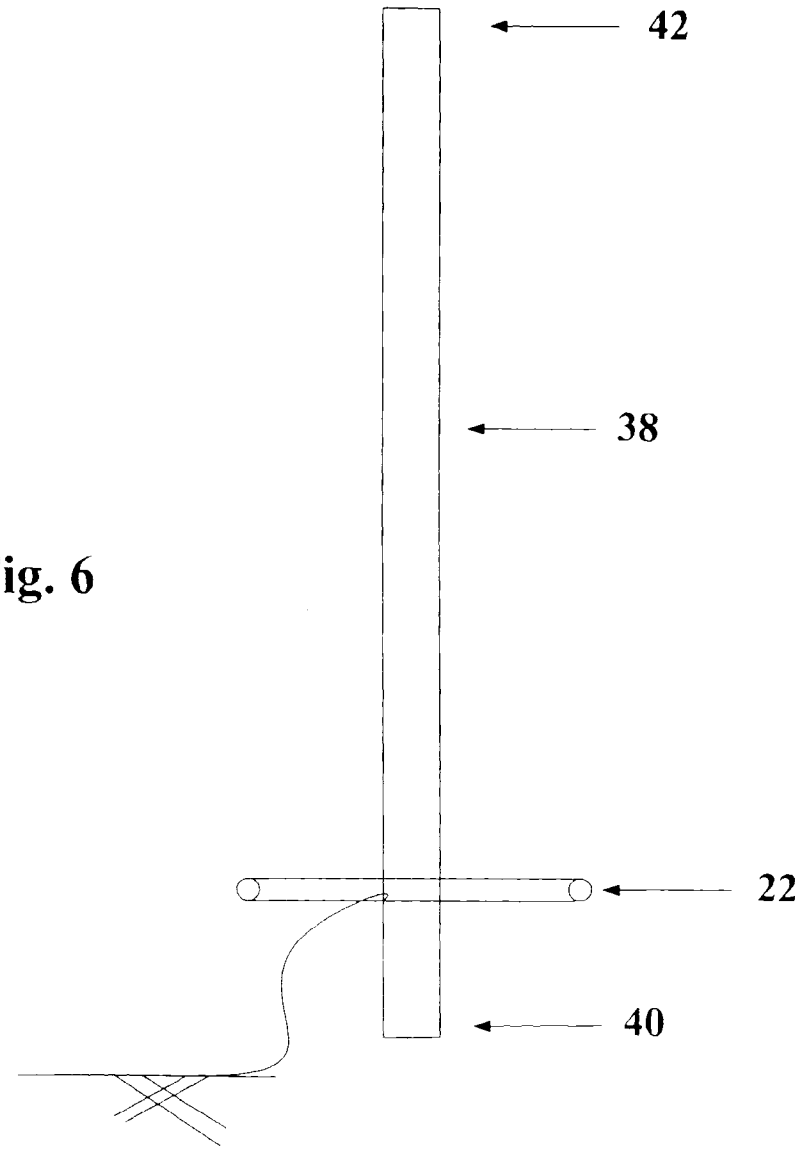
FIG. 6 is a side view of an FRP boom with toroidal inhibitor mounted onto the ground-end of the boom, according to a preferred embodiment of the present invention.

Referring to FIG. 6, there is shown an FRP boom 38 having a ground end 40 and a high voltage end 42. As shown, a toroidal inhibitor 22 is mounted at the ground-end 40 of the boom 38, according to a preferred embodiment of the present invention. The toroidal inhibitor 22 is provided with thin conductor coils (not illustrated) having a diameter not exceeding 0.1 mm and being adapted to be grounded.

Figure 7:
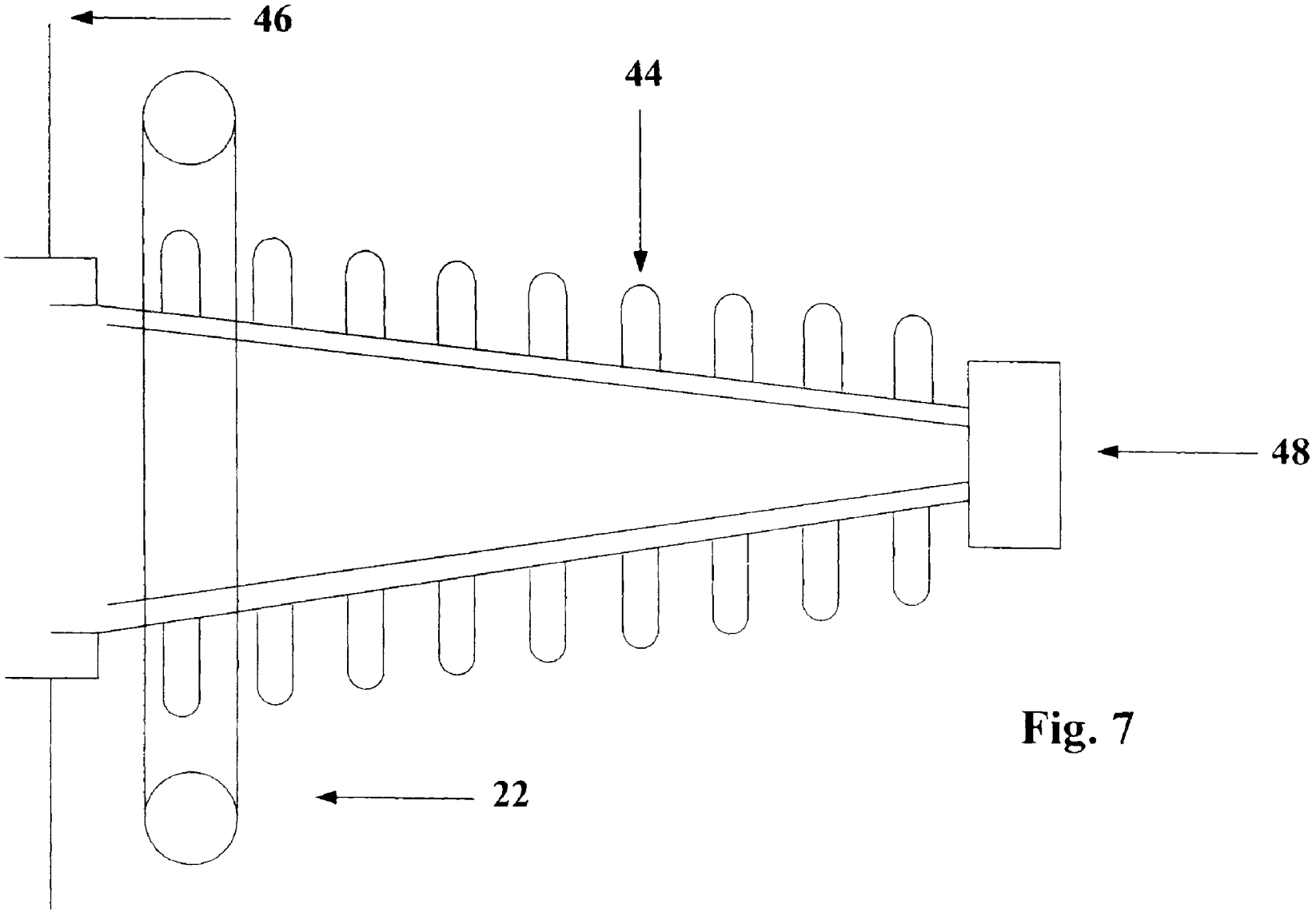
FIG. 7 is a side section view of a negative polarity high voltage DC Wall Bushing with a toroidal inhibitor mounted at the wall-end of the bushing, according to a preferred embodiment of the present invention.

Referring to FIG. 7, there is shown a negative polarity high voltage DC converter wall bushing 44 mounted on a building wall 46. The wall bushing 44 has a high voltage negative pole 48. As shown, a toroidal inhibitor 22 is mounted at the wall-end of the bushing 44, according to a preferred embodiment of the present invention. The toroidal inhibitor 22 is provided with thin conductor coils (not illustrated) having a diameter not exceeding 0.1 mm and being adapted to be grounded.

Figure 8:
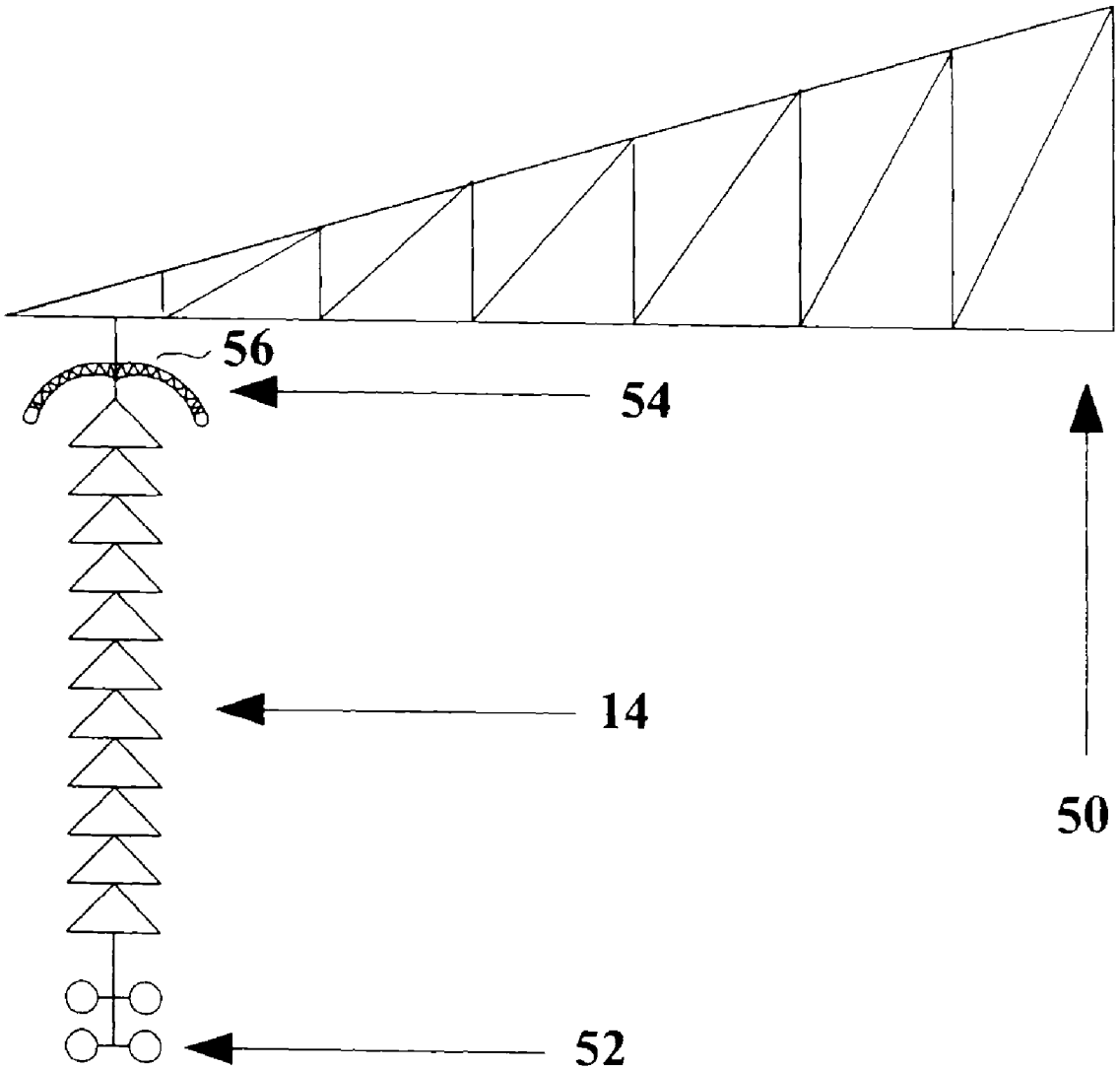
FIG. 8 is a partial section view of a transmission tower with an arcing horn located above an insulator string being wrapped in an inhibitor coil, according to a preferred embodiment of the present invention.

Referring to FIG. 8, there is shown part of a transmission tower 50 supporting an insulator string 14 and a high voltage conductor bundle 52. As shown, an arcing horn 54 is used as the support structure for an inhibitor conductor coil 56 being mounted directly thereon, according to a preferred embodiment of the present invention. The conductor coil 56 has a diameter not exceeding 0.1 mm and is adapted to be grounded.

Tests Conducted

A series of tests were conducted with devices and methods embodying the concepts of the present invention. The objective of the tests was to determine the effect that the procedures and devices described herein would have on the flashover voltage of an FRP stick.

Test Object

The test object comprised a 3 m long fibre-reinforced polymer (FRP) stick normally used in work on energized high voltage direct current (HVDC) transmission lines. The flashover voltage was determined, by the technique described below for ordinary sticks as well as sticks whose ground-ends have been provided with the flashover protection device that is the subject of this patent application and which are referred to as Streamer Inhibiting Electrodes or Inhibitor Electrodes.

Test Technique

The test technique has been devised in order to enhance the probability of the occurrence of streamer initiated or fast flashovers on the FRP stick.

Since in previous tests conducted by Manitoba Hydro on FRP sticks a negative polarity voltage proved to be more severe, only such polarity was used. The FRP stick was prepolluted by a solid layer comprising Kaolin and NACL satisfying IEC Standard 507 to reach a salt deposit density of approximately 2 $\mu g/cm^2$, which was found to be representative of field conditions in live line work (work under voltage).

The tests were carried out in a large fog chamber satisfying the requirement of IEC Standard 507. The rate of steam injection however was reduced to approximately 0.0025 kg/h/$m^3$ of the fog chamber volume in order to extend the effective testing time.

The test started with the application of −300 kVdc to the FRP stick, which was suspended from a two-conductor bundle situated approximately 10 meters above ground, followed in a few minutes by the start of the steam injection.

The relative humidity in the fog chamber is continually monitored and when it reached 70%, the voltage was ramped at a rate of 10 kV/s to −600 kV or up to stick flashover, whichever came first. The voltage is then returned to −300 kV, held for one minute and the ramp voltage application was repeated until the relative humidity reached 85% or until leakage current measured on the FRP stick showed that a pollution type flashover was eminent.

During the tests the following measurements were taken:

fog temperature and relative humidity in the test chamber;

leakage current on the test object by two devices: a normal pollution leakage current measuring system with a sampling rate of approximately 25 kHz and a high speed Tektronix oscilloscope with a sampling rate in the multi MHZ range; and discharges on the test object were monitored by a UV camera (30 frames/s) and a high speed video camera (400-1600 frames/s).

The first series of tests were performed with an FRP stick, without an Inhibitor Electrode, where the clear distance between the high voltage and ground electrodes amounted to 2.7 m (i.e. 90% of the insulating length of the stick). In the second test series the lower ground electrodes was replaced with an Inhibitor Electrode while maintaining the air gap clearance at 2.7 m as in the first test series.

Test Results

For an ordinary FRP stick without Inhibitor Electrode the flashover voltage varied between 442 kV and 336 kV corresponding to a mean gradient per unit length of 112-147 kV/m. For the stick equipped with an Inhibitor Electrode (toroid with an overall diameter of 15 cm and a minor diameter of 2 cm) the limit of the test voltage of −600 kV was reached several times consecutively without ever causing flashover of the FRP stick. This means that even at a mean gradient per unit stick length of 200 kV/m, the FRP stick equipped with an Inhibitor Electrode did not flashover. The success of the device subject to the present invention is self evident.

The flashover protection device and methods according the present invention reduce the risk of such fast flashovers by inhibiting the development of streamers under different atmospheric conditions with the insulators only exposed to the system operating voltage without the application of either lightning or switching voltage transients.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A device for reducing the risk of a flashover on or across a high voltage insulator under normal operating voltages, the device comprising:

a support structure adapted to be grounded and mounted in proximity to the high voltage insulator; and space charge producing conductors wound around the support structure and forming coils for producing space charge and inhibiting a formation of positive streamers, each conductor having a diameter not exceeding 0.1 millimeter for reducing a corona inception voltage of the support structure upon which each conductor is wound, in both dry and wet conditions.

2. The device according to claim 1, wherein the space charge producing conductors are selected from the group including a conducting wire, a bundle of conducting wires, a conducting fiber, a conducting filament, a bundle of conducting filaments, a yarn made of conducting wires, a yarn made of a bundle of conducting wires, a yarn made of conducting fibers, a yarn made of conducting filaments, a yarn made of a bundle of conducting filaments, a knitted fabric made of conducting wires, a knitted fabric made of a bundle of conducting wires, a knitted fabric made of conducting fibers, a knitted fabric made of conducting filaments, a knitted fabric made of a bundle of conducting filaments, a woven fabric made of conducting wires, a woven fabric made of a bundle of conducting wires, a woven fabric made of conducting fibers, a woven fabric made of conducting filaments, a woven fabric made of a bundle of conducting filaments, and wherein each of said wires, fibers and filaments has a diameter not exceeding 0.1 millimeter.

3. The device according to claim 2, wherein the support structure is grounded and is selected from the group including: a continuous toroid, a sectionalized toroid, an open toroid, a continuous metallic toroid, a sectionalized metallic toroid, an open metallic toroid, an arcing horn and fibre-reinforced polymer stick.

4. The device according to claim 3, wherein the space charge producing conductors are wound around the support structure to form a single layer of conductors.

5. The device according to claim 3, wherein the space charge producing conductors are wound around the support structure to form multiple layers of conductors.

6. The device according to claim 3, wherein the space charge producing conductors are wound around the support structure in a longitudinal direction.

7. The device according to claim 3, wherein the space charge producing conductors are further wound around the support structure in a transverse direction.

8. The device according to claim 3, wherein the space charge producing conductors are wound around the support structure in both a longitudinal direction and a transverse direction.

9. The device according to claim 1, wherein the support structure is provided with arcing terminals.

10. The device according to claim 1, wherein the support structure is made of a conducting material.

11. A method of making a device for reducing the risk of a flashover across or on a high voltage insulator under normal operating voltages, the method comprising steps of:

a) providing a support structure adapted to be grounded and mounted in proximity to the high voltage insulator; and b) winding space charge producing conductors around the support structure and forming coils for producing space charge and inhibiting a formation of positive streamers, each conductor having a diameter not exceeding 0.1 millimeter for reducing a corona inception voltage of the support structure upon which each conductor is wound, in both dry and wet conditions.

12. The method according to claim 11, wherein the space charge producing conductors are selected from the group including a conducting wire, a bundle of conducting wires, a conducting fiber, a conducting filament, a bundle of conducting filaments, a yarn made of conducting wires, a yarn made of a bundle of conducting wires, a yarn made of conducting fibers, a yarn made of conducting filaments, a yarn made of a bundle of conducting filaments, a knitted fabric made of conducting wires, a knitted fabric made of a bundle of conducting wires, a knitted fabric made of conducting fibers, a knitted fabric made of conducting filaments, a knitted fabric made of a bundle of conducting filaments, a woven fabric made of conducting wires, a woven fabric made of a bundle of conducting wires, a woven fabric made of conducting fibers, a woven fabric made of conducting filaments, a woven fabric made of a bundle of conducting filaments, and wherein each of said wires, fibers and filaments has a diameter not exceeding 0.1 millimeter.

13. The method according to claim 12, wherein the support structure is grounded and is selected from the group including: a continuous toroid, a sectionalized toroid, an open toroid, a continuous metallic toroid, a sectionalized metallic toroid, an open metallic toroid, an arcing horn and a fibre-reinforced polymer (FRP) stick.

14. The method according to claim 13, wherein step b) comprises steps of selecting a given winding pitch of the coils formed by the space charge producing conductors and selecting a given length of the space charge producing conductors wound around the support structure to control a rate of the space charge that is produced in the proximity of an insulator to be protected for any given field produced by the energized line.

15. The method according to claim 12, wherein step a) comprises steps of selecting a given length of the support structure and selecting a given length of the space charge producing conductors to control a value of the rate of the space charge that is produced in the proximity of an insulator to be protected for any given field produced by the energized line.

16. The method according to claim 12, wherein step a) comprises steps of selecting a given diameter of the support structure and selecting a length of the space charge producing conductors to control a value of the rate of the space charge that is produced in the proximity of an insulator to be protected for any given field produced by the energized line.

17. The method according to claim 11, wherein the support structure is a conducting support structure and step a) comprises a step of selecting a diameter of the conducting support structure to control an electric field to which the space charge producing conductors are exposed for any given field produced by the energized line.

18. The method according to claim 11, wherein the support structure is a conducting support structure and step a) comprises a step of providing arcing terminals for receiving and maintaining a power-follow arc.

19. The method according to claim 11, wherein step a) comprises a step of positioning the support structure around an insulator to be protected.

20. The method according to claim 11, wherein step a) comprises a step of positioning the support structure in close proximity to the insulator to be protected.

21. Two or more devices for reducing the risk of a streamer initiated flashover across or on a high voltage insulator under normal operating voltage, each device comprising:

a support structure adapted to be grounded and mounted in proximity to the high voltage insulator; and space charge producing conductors wound around the support structure and forming coils for producing space charge and inhibiting a formation of positive streamers, each conductor having a diameter not exceeding 0.1 millimeter for reducing a corona inception voltage of the support structure upon which each conductor is wound in both dry and wet conditions.

22. A device for reducing the risk of a flashover on or across an insulator of a certain length with a cross section defining a cross sectional thickness or diameter, the device comprising:

(a) a support structure defining an inner opening for receiving the insulator there through, the structure spanning generally radially outwardly from the inner opening to lie substantially transversely to a longitudinal direction of the insulator received there through, and (b) space charge producing conductors disposed on the support structure and forming coils for producing space charge and reducing the risk of flashover on or across the insulator.

23. The device according to claim 22, wherein the support structure is adapted to be grounded.

24. The device according to claim 22, wherein the support structure has a substantially circular disc configuration with an inner opening having a bore diameter that is larger than the thickness or diameter of the insulator.

25. The device according to claim 22, wherein the support structure is a substantially cylindrical, bi-convex, semi-convex, biconcave, semi-concave, spheroidal, or semi-spheroidal disc.

26. The device according to claim 22, wherein the support structure is selected from the group including: a continuous toroid, a sectionalized toroid, an open toroid, a continuous metallic toroid, a sectionalized metallic toroid, an open metallic toroid, an arcing horn and fibre-reinforced polymer (FRP) stick.

27. The device according to claim 22, wherein the support structure is made of a conducting material.

28. The device according to claim 22, wherein the conductors are selected from the group including a conducting wire, a bundle of wires, a fiber, a filament, a bundle of filaments, a yarn made of wires, a yarn made of a bundle of wires, a yarn made of fibers, a yarn made of filaments, a yarn made of a bundle of filaments, a knitted fabric made of wires, a knitted fabric made of a bundle of wires, a knitted fabric made of fibers, a knitted fabric made of filaments, a knitted fabric made of a bundle of filaments, a woven fabric made of wires, a woven fabric made of a bundle of wires, a woven fabric made of fibers, a woven fabric made of filaments, a woven fabric made of a bundle of filaments.

29. The device according to claim 28, wherein the conductors have a diameter or thickness not substantially exceeding 0.1 millimeter.

30. A device for reducing the risk of a flashover on or across a high voltage insulator under normal operating voltages, the device comprising:

a support structure adapted to be grounded and mounted in proximity to the high voltage insulator; and space charge producing conductors disposed on the support structure and forming coils for producing space charge and reducing the risk of flashover on or across the high voltage insulator.

31. The device according to claim 30, wherein the conductors are selected from the group including a conducting wire, a bundle of conducting wires, a conducting fiber, a conducting filament, a bundle of conducting filaments, a yarn made of conducting wires, a yarn made of a bundle of conducting wires, a yarn made of conducting fibers, a yarn made of conducting filaments, a yarn made of a bundle of conducting filaments, a knitted fabric made of conducting wires, a knitted fabric made of a bundle of conducting wires, a knitted fabric made of conducting fibers, a knitted fabric made of conducting filaments, a knitted fabric made of a bundle of conducting filaments, a woven fabric made of conducting wires, a woven fabric made of a bundle of conducting wires, a woven fabric made of conducting fibers, a woven fabric made of conducting filaments, a woven fabric made of a bundle of conducting filaments.

32. The device according to claim 30, wherein the conductors have a diameter not exceeding 0.1 millimeter.

33. The device according to claim 30, wherein the support structure is grounded and is selected from the group including: a continuous toroid, a sectionalized toroid, an open toroid, a continuous metallic toroid, a sectionalized metallic toroid, an open metallic toroid, an arcing horn and fibre-reinforced polymer stick.

34. The device according to claim 30, wherein the conductors are wound around the support structure to form a single layer of conductors.

35. The device according to claim 30, wherein the conductors are wound around the support structure to form multiple layers of conductors.

36. The device according to claim 30, wherein the conductors are wound around the support structure in a longitudinal direction.

37. The device according to claim 36, wherein the conductors are further wound around the support structure in a transverse direction.

38. The device according to claim 30, wherein the conductors are wound around the support structure in both a longitudinal direction and a transverse direction.

39. The device according to claim 30, wherein the support structure is provided with arcing terminals.

40. The device according to claim 30, wherein the support structure is made of a conducting material.

* * * * *